US011465258B2

(12) United States Patent
Echasserieau

(10) Patent No.: US 11,465,258 B2
(45) Date of Patent: Oct. 11, 2022

(54) TOOL FOR PICKLING BY MEANS OF SPRAYING AND SUCTION

(71) Applicant: Airbus Operations SAS, Toulouse (FR)

(72) Inventor: Gilles Echasserieau, Cordemais (FR)

(73) Assignee: AIRBUS OPERATIONS SAS, Toulouse (FR)

( * ) Notice: Subject to any disclaimer, the term of this patent is extended or adjusted under 35 U.S.C. 154(b) by 275 days.

(21) Appl. No.: 16/797,531

(22) Filed: Feb. 21, 2020

(65) Prior Publication Data

US 2020/0269386 A1 Aug. 27, 2020

(30) Foreign Application Priority Data

Feb. 25, 2019 (FR) ..... 1901873

(51) Int. Cl.

| | |
|---|---|
| ***B24C 1/08*** | (2006.01) |
| ***B08B 5/04*** | (2006.01) |
| ***B08B 7/00*** | (2006.01) |

(52) U.S. Cl.

CPC ..... *B24C 1/086* (2013.01); *B08B 5/04* (2013.01); *B08B 7/00* (2013.01)

(58) Field of Classification Search

None

See application file for complete search history.

(56) References Cited

U.S. PATENT DOCUMENTS

2018/0297172 A1 10/2018 Usui et al.

FOREIGN PATENT DOCUMENTS

| | | | |
|---|---|---|---|
| DE | 3834896 | A1 | 4/1990 |
| DE | 20121272 | U1 | 6/2002 |
| EP | 3375568 | A1 | 9/2018 |
| FR | 2645062 | A1 | 10/1990 |

OTHER PUBLICATIONS

French Search Report; priority document, 2019, 2 pages, not in English.

*Primary Examiner* — Eric W Golightly

(74) *Attorney, Agent, or Firm* — Greer, Burns & Crain, Ltd.

(57) ABSTRACT

A pickling tool configured for pickling a surface of an element, comprising a supply conduit delimiting a supply channel configured to be in pneumatic communication with a source of compressed air laden with a powder of an abrasive product, a removal conduit delimiting a removal channel configured to be in pneumatic communication with a suction source, and a nozzle having an opening that communicates with an exterior and is configured to face the surface, wherein the nozzle is in pneumatic communication with the supply channel and the removal channel. Such a tool thus allows the passage of a flow of air for spraying the abrasive and the suction of the abrasive and of the powder arising from abrasion.

12 Claims, 2 Drawing Sheets

TOOL FOR PICKLING BY MEANS OF SPRAYING AND SUCTION

CROSS-REFERENCES TO RELATED APPLICATIONS

This application claims the benefit of the French patent application No. 1901873 filed on Feb. 25, 2019, the entire disclosures of which are incorporated herein by way of reference.

FIELD OF THE INVENTION

The present invention relates to a pickling tool that makes it possible to pickle a surface by means of spraying and suction, and also to a pickling system using such a pickling tool.

BACKGROUND OF THE INVENTION

To achieve a contact between two mutually conducting metal components and thus to ensure good electrical conductivity, it is known to pickle the two metal components with a view to exposing the metal surfaces.

Several solutions are used to achieve such pickling. It is possible to use an abrasion element such as, for example, an abrasive paper. It is also possible to use tools, such as a metallizing milling cutter or a laser.

None of these methods is entirely satisfactory because they degrade the metal surface or require tools that are expensive and bulky.

SUMMARY OF THE INVENTION

An object of the present invention is to propose a pickling tool that makes it possible to pickle a surface by means of spraying an abrasive and suction with a view to aspirating the dust and the abrasive.

To that end, a pickling tool is proposed which is configured to pickle a surface of an element, the pickling tool comprising:

- a supply conduit delimiting a supply channel configured to be in pneumatic communication with a source of compressed air laden with a powder of an abrasive product,
- a removal conduit delimiting a removal channel configured to be in pneumatic communication with a suction source, and
- a nozzle having an opening that communicates with the exterior and is configured to face the surface, wherein the nozzle is in pneumatic communication with the supply channel and the removal channel, wherein the supply conduit is an interior conduit and the removal conduit is an exterior conduit in which the interior conduit is accommodated, wherein the pickling tool comprises a guide that traverses the opening and is secured to the supply conduit.

The invention also proposes a pickling tool configured for pickling a surface of an element, the pickling tool comprising:

- a supply conduit delimiting a supply channel configured to be in pneumatic communication with a source of compressed air laden with a powder of an abrasive product,
- a removal conduit delimiting a removal channel configured to be in pneumatic communication with a suction source, and

- a nozzle having an opening that communicates with the exterior and is configured to face the surface, wherein the nozzle is in pneumatic communication with the supply channel and the removal channel, wherein the removal conduit is an interior conduit and the supply conduit is an exterior conduit in which the interior conduit is accommodated, wherein the pickling tool comprises a guide that traverses the opening and is secured to the removal conduit.

Such a tool thus allows the passage of a flow of air for spraying the abrasive and the suction of the abrasive and of the dust arising from abrasion.

Advantageously, the pickling tool comprises a seal fixed around the opening.

Advantageously, the opening is made at the end of the removal conduit.

Advantageously, the supply conduit comprises a proximal part and a distal part, the proximal part is fixed and in pneumatic communication with the source of compressed air, the distal part is mounted movable in rotation at the end of the proximal part and opens out in the nozzle, the end of the distal part that opens out in the nozzle is closed off by a plug pierced with perforations traversing it, and the pickling tool comprises means for rotating the distal part.

Advantageously, the means for rotating comprise an air conduit and fins, the air conduit delimits an air channel in pneumatic communication with the source of compressed air, the distal part carries the set of fins that are arranged in the air channel in such a manner that the flow of air that circulates in the air channel interacts with the fins such as to cause the distal part to turn, and the air conduit opens out in the removal conduit downstream of the fins.

Advantageously, the opening is made at the end of the supply conduit.

Advantageously, the guide is removable.

The invention also proposes a pickling system comprising:

- a source of compressed air,
- a reservoir containing a powder of an abrasive product,
- a suction source,
- a pickling tool according to one of the preceding variants,
- a supply pipe extending between the source of compressed air and the supply channel traversing the reservoir, wherein the supply pipe comprises a charging system that makes it possible to extract powder from the reservoir and to inject it into the flow of air in the supply pipe, and
- a removal pipe extending between the removal channel and the suction source

BRIEF DESCRIPTION OF THE DRAWINGS

The above-mentioned features of the invention and also other features will become more clearly apparent upon reading the following description of an exemplary embodiment, the description being given with reference to the appended drawings, in which.

DETAILED DESCRIPTION OF THE PREFERRED EMBODIMENTS

Figure 1:
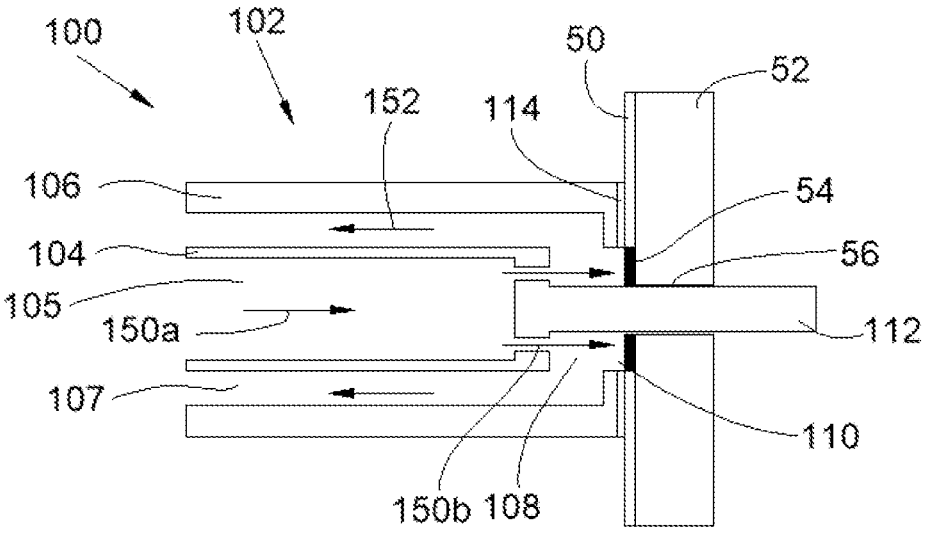
FIG. 1 is a view from the side and in cross section of a pickling tool according to a first embodiment of the invention.
Figure 2:
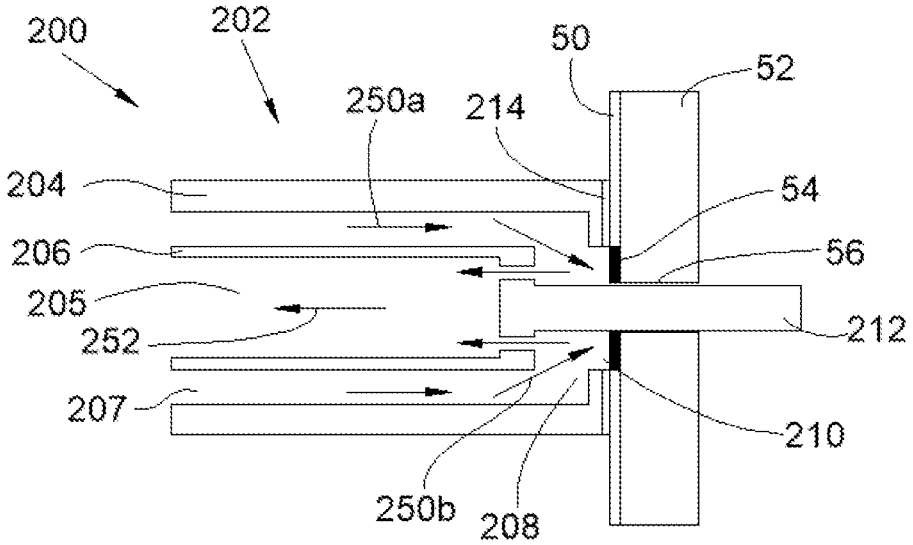
FIG. 2 is a view from the side and in cross section of a pickling tool according to a second embodiment of the invention.

FIG. 1 shows a pickling tool 100 according to a first embodiment of the invention and FIG. 2 shows a pickling tool 200 according to a second embodiment of the invention.

The pickling tool 100, 200 is used to pickle the surface 50 of an element 52, for example to remove paint or rust from a metal element. The zone 54 is the zone to be pickled and removed at the end of pickling.

The pickling tool 100, 200 comprises a body 102, 202 comprising a supply conduit 104, 204 and a removal conduit 106, 206. The supply conduit 104, 204 delimits a supply channel 105, 205 and the removal conduit 106, 206 delimits a removal channel 107, 207.

In the embodiment of FIG. 1, the supply conduit 104 is an interior conduit and the removal conduit 106 is an exterior conduit in which the interior conduit is accommodated, i.e., the exterior conduit is around the interior conduit.

In the embodiment of FIG. 2, the removal conduit 206 is an interior conduit and the supply conduit 204 is an exterior conduit in which the interior conduit is accommodated, i.e., the exterior conduit is around the interior conduit.

As described below, the supply channel 105, 205 is configured to be in pneumatic communication with a source of compressed air laden with a powder of an abrasive product and the removal channel 107, 207 is configured to be in pneumatic communication with a suction source.

Figure 3:
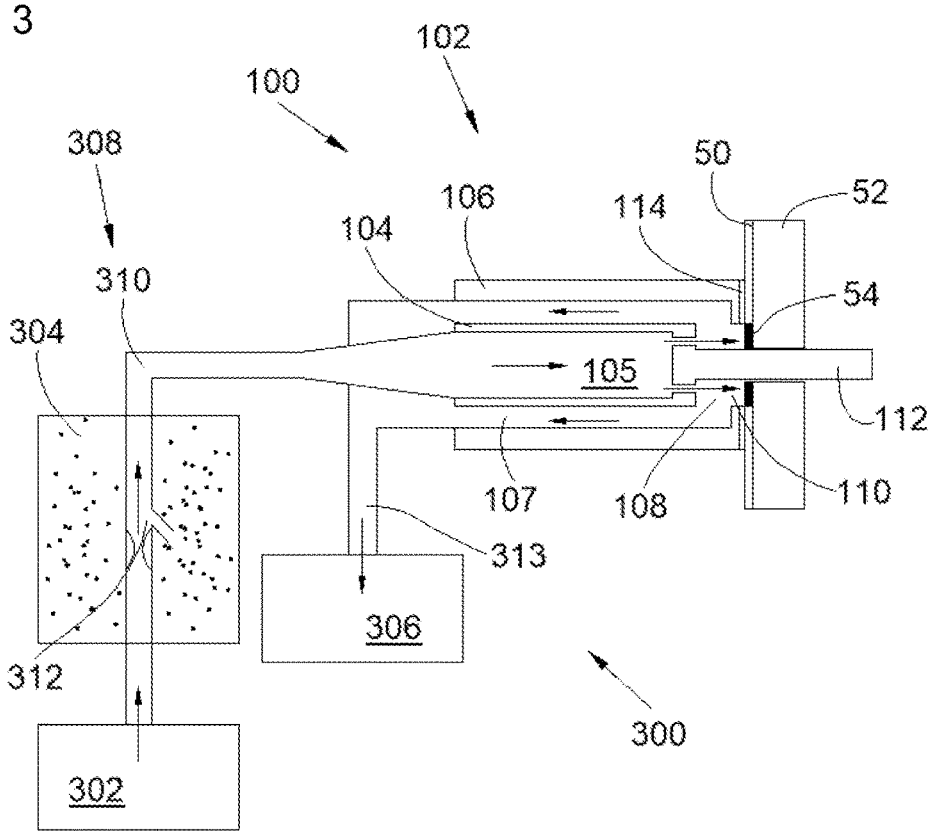
FIG. 3 is a schematic representation of a pickling system according to the invention.

FIG. 3 shows a pickling system 300 using the pickling tool 100 of FIG. 1. FIG. 3 is described with the pickling tool 100 of FIG. 1, but it functions in the same way with the pickling tool 200 of FIG. 2, the positions of the supply 104, 204 and removal 106, 206 conduits being inverted.

The pickling system 300 comprises a source 302 of compressed air such as, for example, a compressor.

The pickling system 300 also comprises a reservoir 304 containing a powder of an abrasive product such as, for example, sodium bicarbonate, aluminum silicate, calcite, etc.

The pickling system 300 also comprises a suction source 306 that aspirates the air and the dust after abrasion.

According to another embodiment, the suction source 306 is in pneumatic communication with the reservoir 304, so the paint that is stripped off returns to the reservoir 304 and thus forms a powder component of the abrasive product.

The pickling system 300 also comprises a pipe circuit 308 with a supply pipe 310 and a removal pipe 313.

The supply pipe 310 extends between the source 302 of compressed air and the supply channel 105, traversing the reservoir 304 where the air is laden with powder of the abrasive product. To that end, the supply pipe 310 is equipped with a charging system 312 that makes it possible to extract powder from the reservoir 304 and to inject it into the flow of air of the supply pipe 310 such as, for example, a Venturi-effect system or any other pressurized or overpressure system.

The removal pipe 313 extends between the removal channel 107 and the suction source 306.

The pickling tool 100, 200 comprises a nozzle 108, 208 that has an opening 110, 210 that communicates with the exterior and faces the surface 50 to be pickled.

The nozzle 108, 208 is in pneumatic communication with the supply channel 105, 205 and the removal channel 107, 207. Thus, the compressed air laden with powder of the abrasive product circulates in the supply channel 105, 205 as far as the nozzle 108, 208 where it is ejected via the opening 110, 210 and enters into contact with the surface 50 to be pickled, and then the air laden with powder of the abrasive product and dust arising from pickling is aspirated towards the nozzle 108, 208 then into the removal channel 107, 207 towards the suction source 306.

The opening 110, 210 defines the pickling diameter, but it is possible to modify this diameter by fixing a crown along the exterior edge of the opening 110, 210 so as to modify the diameter thereof.

In FIG. 1, the arrows 150*a-b* show the direction of the compressed air in the supply conduit 104 and the nozzle 108, and the arrows 152 show the direction of the compressed air in the removal conduit 106.

In FIG. 2, the arrows 250*a-b* show the direction of the compressed air in the supply conduit 204 and the nozzle 208, and the arrows 252 show the direction of the compressed air in the removal conduit 206.

In the embodiment of FIG. 1, the opening 110 is made at the end of the removal conduit 106 that forms a bearing surface bearing against the surface 50. In the embodiment of FIG. 2, the opening 210 is made at the end of the supply conduit 204 that forms a bearing surface bearing against the surface 50.

When the zone 54 to be pickled is around a bore 56 of the element 52, the pickling tool 100, 200 comprises a guide 112, 212 that traverses the opening 110, 210 and passes into the bore 56 so as to guarantee accurate positioning of the pickling tool 100, 200 relative to the bore 56. In the embodiments of FIGS. 1 and 2, the guide 112, 212 assumes the form of a stud.

In the embodiment of FIG. 1, the guide 112 is secured to the end of the supply conduit 104.

In the embodiment of FIG. 2, the guide 212 is secured to the end of the removal conduit 206.

In the embodiments of FIGS. 1 and 2, the guide 112, 212 is fixed, but it is possible to make provision for it to be removable such as to be able to adapt the pickling tool 100, 200 to bores 56 of different diameters.

To ensure satisfactory sealing between the pickling tool 100, 200 and the surface 50, the pickling tool 100, 200 comprises a seal 114, 214 fixed around the opening 110, 210 and bearing against the surface 50, i.e., the end of the removal conduit 106 in the case of the embodiment of FIG. 1 and the end of the supply conduit 204 in the case of the embodiment of FIG. 2.

In the embodiment of the invention presented in the figures, the supply conduit 104, 204 and the removal conduit 106, 206 are concentric and perpendicular to the surface 50, but it is possible to make provision for another set-up. For example, the two conduits may be arranged obliquely relative to the surface 50 and each on either side of a plane perpendicular to the surface.

In the embodiments of FIGS. 1 and 2, the supply conduits 104 are fixed, but it is possible to make provision for some of the supply conduits 104 to be driven in a rotary movement or an oscillatory movement. The pickling tool then comprises means for rotating the movable part of the supply conduit 104, which means may be an electric motor or a system based on compressed air originating from the source 302 of compressed air, or from the removal pipe 313, so as to impart a circular movement to the powder of the abrasive product.

Figure 4:
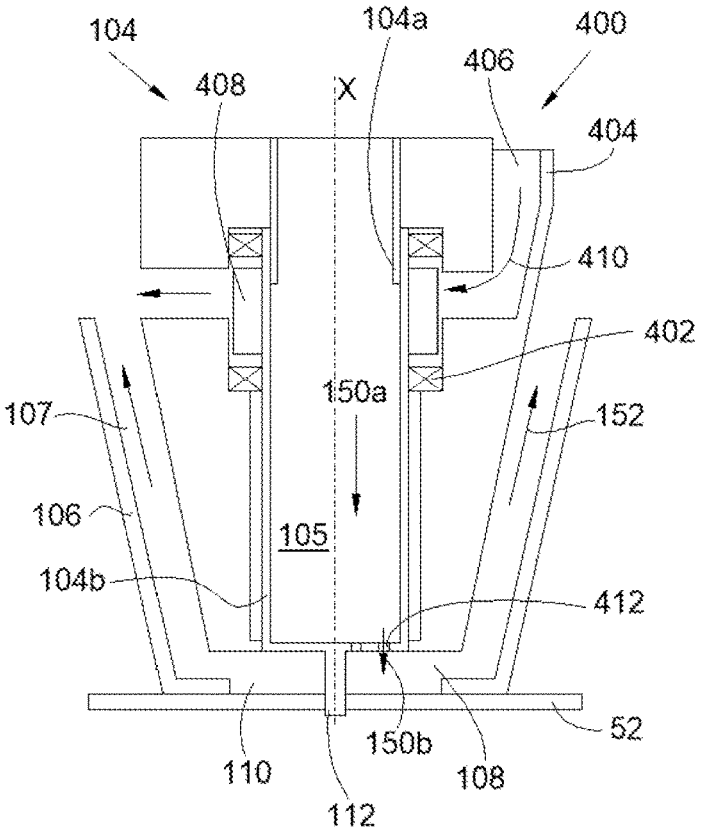
FIG. 4 is a cross-sectional view of a pickling tool according to a particular embodiment of the first embodiment.

FIG. 4 shows a cross-sectional view of a pickling tool 400 that constitutes a variant of the first embodiment of the invention and the supply conduit 104 of which comprises a proximal part 104*a* and a distal part 104*b*. The proximal part 104*a* is fixed and in pneumatic communication with the source of compressed air laden with powder of the abrasive product. The distal part 104*b* is mounted to be moveable in rotation at the end of the proximal part 104*a* about a longitudinal axis X. The distal part 104*b* thus extends between the proximal part 104*a* and the nozzle 108 into which it opens out.

The end of the distal part 104*b* that opens out in the nozzle 108 is closed off by a plug and the distal part 104*b* opens out in the nozzle 108 via perforations 412 traversing the plug, which allows an increase in outlet pressure.

To that end, the distal part 104*b* is mounted to be moveable in rotation inside the removal conduit 106 by means of at least one ball bearing 402, here being two in number and mounted between the distal part 104*b* and the lower part of the removal conduit 106.

The means for rotating the distal part 104*b* comprise an air conduit 404 and fins 408.

The air conduit 404 delimits an air channel 406 that is pneumatic communication with the source 302 of compressed air.

The distal part 104*b* carries a set of fins 408 arranged in the air channel 406 about the longitudinal axis X in such a manner that the flow of air 410 circulating in the air channel 406 interacts with the fins 408 such as to cause the distal part 104*b* to turn.

Downstream of the fins 408, the air conduit 404 opens out in the removal conduit 106 in such a manner that, after having turned the fins 408, the flow of air circulating in the air channel 406 joins the removal channel 107 in order to be discharged.

In so far as the plug turns with the distal part 104*b*, the perforations 412 may be located solely on a part of the plug, in particular along a radius.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A pickling tool configured for pickling a surface of an element, said pickling tool comprising:

a supply conduit delimiting a supply channel configured to be in pneumatic communication with a source of compressed air laden with a powder of an abrasive product, a removal conduit delimiting a removal channel configured to be in pneumatic communication with a suction source, and a nozzle having an opening that communicates with an exterior and is configured to face the surface, wherein the nozzle is in pneumatic communication with the supply channel and the removal channel, wherein the supply conduit is an interior conduit and the removal conduit is an exterior conduit in which the interior conduit is accommodated, and wherein the pickling tool comprises a guide that traverses the opening and is secured to the supply conduit.

2. The pickling tool according to claim 1, further comprising a seal fixed around the opening.

3. The pickling tool according to claim 1, wherein the opening is made at an end of the removal conduit.

4. The pickling tool according to claim 1, wherein the supply conduit comprises a proximal part and a distal part, wherein the proximal part is fixed and in pneumatic communication with the source of compressed air, wherein the distal part is mounted movable in rotation at an end of the proximal part and opens out in the nozzle, wherein the end of the distal part that opens out in the nozzle is closed off by a plug pierced with perforations traversing it, and wherein the pickling tool comprises means for rotating the distal part.

5. The pickling tool according to claim 4, wherein the means for rotating comprise an air conduit and fins, wherein the air conduit delimits an air channel in pneumatic communication with the source of compressed air, wherein the distal part carries fins that are arranged in the air channel in such a manner that a flow of air that circulates in said air channel interacts with the fins such as to cause the distal part to turn, and wherein the air conduit opens out in the removal conduit downstream of the fins.

6. The pickling tool according to claim 1, wherein the guide is removable.

7. A pickling system comprising:

a source of compressed air, a reservoir containing a powder of an abrasive product, a suction source, a pickling tool according to claim 1, a supply pipe extending between the source of compressed air and the supply channel traversing the reservoir, wherein the supply pipe comprises a charging system that makes it possible to extract powder from the reservoir and to inject it into a flow of air in the supply pipe, and a removal pipe extending between the removal channel and the suction source.

8. A pickling tool configured for pickling a surface of an element, said pickling tool comprising:

a supply conduit delimiting a supply channel configured to be in pneumatic communication with a source of compressed air laden with a powder of an abrasive product, a removal conduit delimiting a removal channel configured to be in pneumatic communication with a suction source, and a nozzle having an opening that communicates with an exterior and is configured to face the surface, wherein the nozzle is in pneumatic communication with the supply channel and the removal channel, wherein the removal conduit is an interior conduit and the supply conduit is an exterior conduit in which the interior conduit is accommodated, and wherein the pickling tool comprises a guide that traverses the opening and is secured to the removal conduit.

9. The pickling tool according to claim 8, further comprising a seal fixed around the opening.

10. The pickling tool according to claim 8, wherein the opening is produced at an end of the supply conduit.

11. The pickling tool according to claim 8, wherein the guide is removable.

12. A pickling system comprising:

a source of compressed air, a reservoir containing a powder of an abrasive product, a suction source, a pickling tool according to claim 8, a supply pipe extending between the source of compressed air and the supply channel traversing the reservoir, wherein the supply pipe comprises a charging system that makes it possible to extract powder from the reservoir and to inject it into a flow of air in the supply pipe, and a removal pipe extending between the removal channel and the suction source.

* * * * *